US005253988A

United States Patent [19]

Hunziker et al.

[11] Patent Number: 5,253,988

[45] Date of Patent: Oct. 19, 1993

[54] GEAR PUMP

[75] Inventors: Alfred K. Hunziker, Gundetswil; Fritz Haupt; Eduard Mischler, both of Regensdorf; Stefan Kalt, Spreitenbach, all of Switzerland

[73] Assignee: Maag Pump Systems AG, Zurich, Switzerland

[21] Appl. No.: 842,714

[22] Filed: Feb. 27, 1992

[30] Foreign Application Priority Data

Feb. 27, 1991 [CH] Switzerland ..... 593/91

[51] Int. Cl.[5] ..... F04C 15/00

[52] U.S. Cl. ..... 418/1; 418/87; 418/98; 418/102

[58] Field of Search ..... 418/102, 87, 98, 1, 418/15

[56] References Cited

U.S. PATENT DOCUMENTS

| | | | |
|---|---|---|---|
| 1,561,364 | 11/1925 | Smith | 418/87 X |
| 2,479,077 | 8/1949 | McAlvay | 418/102 X |
| 3,433,168 | 3/1969 | Banker | 418/1 |
| 3,975,123 | 8/1976 | Schibbye | 418/102 X |
| 4,153,400 | 5/1979 | Morita | 418/102 |
| 5,090,879 | 2/1992 | Weinbrecht | 418/15 X |

FOREIGN PATENT DOCUMENTS

| | | | |
|---|---|---|---|
| 0024024 | 2/1981 | European Pat. Off. | 418/102 |
| 541377 | 1/1932 | Fed. Rep. of Germany | 418/87 |
| 969554 | 9/1964 | United Kingdom . | |

*Primary Examiner*—Richard E. Gluck
*Attorney, Agent, or Firm*—Louis Weinstein

[57] ABSTRACT

Method and apparatus for on-site cleaning of a gear pump by coupling the gear pump outlet to the gear pump inlet and to the inlet end of the passage and which bypasses the bearing and is preferably controlled by a valve element which can block off the bypass in normal operation and be opened for a cleaning operation to increase the pressure on the side of the bearing connected to the inlet and thereby increase the velocity of the flushing stream.

23 Claims, 3 Drawing Sheets

GEAR PUMP

FIELD OF THE INVENTION

This invention relates to gear pumps, and more particularly, to a novel method and apparatus for cleaning gear pumps either through the use of a cleansing medium or the product normally conveyed by the gear pump.

BACKGROUND OF THE INVENTION

In known gear pumps of this type, the bearings are lubricated by the product being conveyed. In many applications of such gear pumps, the demand is being made today that the pump should be cleanable on-site, that is, in the installed state, by the use of a flushing agent, which is transported by the pump just like the product conveyed by the gear pump. Experience has shown, however, that deposits formed by the conveyed product often remain behind in the pump. In cases of strict requirements on the purity of the product, this type of cleaning is thus not sufficiently effective, because fresh product can become contaminated by these deposits.

Depending on the flow behavior, another problem with the products conveyed by known gear pumps is that the residence times are often widely distributed. In the case of sensitive products, such residence time distributions can frequently make it necessary to shut down operation to allow the equipment to be cleaned.

OBJECT OF THE INVENTION

One object of the invention is to create a gear pump which makes it easy to exert a variable effect on the flow conditions in the area of a system of passages serving to lubricate the gear pump bearings.

BRIEF DESCRIPTION OF THE INVENTION

The above object is accomplished by providing a gear pump which is preferably especially adapted for use in conveying pasty products and comprising a housing having an inlet and an outlet channel; a plurality of gear bodies having bearing journals; bearings supporting said bearing journals and hence said gear bodies for rotation in said housing; and a system of passages which includes the bearings and which are connected to the outlet channel to permit circulation of a leakage stream of the product being conveyed wherein the system of passages includes at least one valve element for varying the flow on the low pressure side of the bearings.

The solution to the problem according to the invention is based on the observation that deposits occur primarily on the low pressure side of the bearing. With the goal of achieving a high volumetric efficiency in the gear pump and thus to minimize the losses attributable to the bearing lubrication stream component of the total leakage flow, the pressure on this side of the bearing, i.e., the side connected to the inlet channel, is usually only slightly higher than that in the inlet channel, i.e., just high enough so that the remaining pressure gradient is sufficient to ensure the continuous return flow of the bearing lubrication streams. Therefore, the flow on the side of the bearing indicated cannot under normal conditions be sufficient to exert at that point a sufficient flushing action.

The solution according to the invention now makes it possible to change the pressure and flow conditions during operation in the zones especially susceptible to deposits and thus to expose these zones to a pressure higher and a flow more intense than that of normal pumping operation. The intensified flow, which is usually generated during on-site cleaning by the flushing agent conveyed by the pump can also, if desired, be used in product transport mode, so that, for example, in the case of a highly sensitive product, flushing can be carried out with this product itself by means of a temporary, e.g. periodically intensified, flow.

In accordance with a preferred embodiment of the invention, in which each bearing is connected directly to the inlet channel, the system of passage includes a section which couples the outlet to the inlet, bypassing the bearing and which is controlled by a valve element. In normal operation, the valve element can block off the bypass, but this bypass can also be opened for flushing operation, e.g. during cleaning with a flushing agent, to increase the pressure on the side of the bearing connected to the inlet and thus to increase the velocity of the flushing stream.

According to another preferred embodiment of the invention, the valve element is installed between the bearing and the inlet channel and thus allows the pressure on this side of the bearing to be changed or to be increased for cleaning with a flushing agent. It is also possible to adapt the bearing lubrication stream to the flow properties of the various media required, such as to the flow properties of the flushing agent used for on-site cleaning, which properties can be considerably different from those of the actual product to be conveyed.

BRIEF DESCRIPTION OF THE FIGURES

In the following, several exemplary embodiments of the gear pump according to the invention and processes for its operation are explained in greater detail on the basis of the drawing.

DETAILED DESCRIPTION OF THE INVENTION AND THE PREFERRED EMBODIMENTS THEREOF

Figure 1:
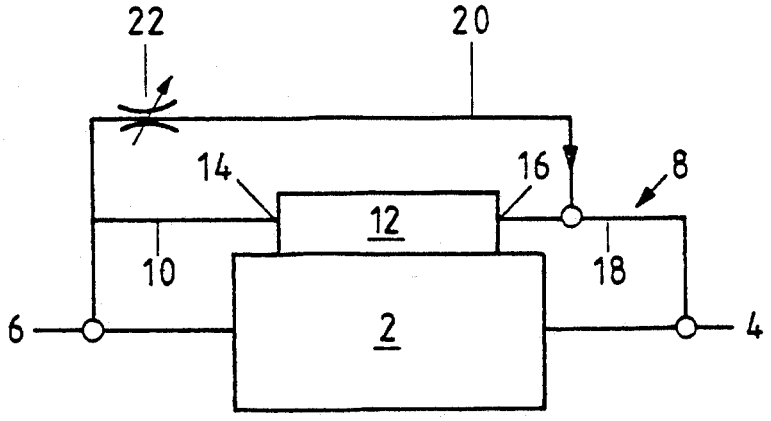
FIG. 1 shows a schematic diagram of the system of passages of the gear pump in accordance with a first exemplary embodiment.

FIG. 1 shows in general a gear pump 2, which has an inlet channel 4 and an outlet channel 6 for a product to be conveyed. A system of passages 8 is illustrated schematically; this system connects outlet channel 6 to inlet channel 4 and includes sections for the flow of bearing lubricant. For simplicity, only one bearing 12 is shown, and, for the purposes of schematic representation, the bearing is represented only by its clearance gap. A passage 10, again shown schematically, is located between outlet channel 6 and pressure side 14 of bearing 12, this passage represents the connection to the high pressure side of the gear pump present in the case of internal bearings. Inlet channel 4, which is on the suction side of pump 2, is connected to low pressure side 16 of bearing 12 by way of a passage 18.

The system of passages 8 includes a bypass 20, which connects low pressure side 16 of bearing 12 to outlet channel 6 an the pressure side of gear pump 2. Bypass 20 contains an adjustable valve element 22 in the form of a throttle valve.

Figure 2:
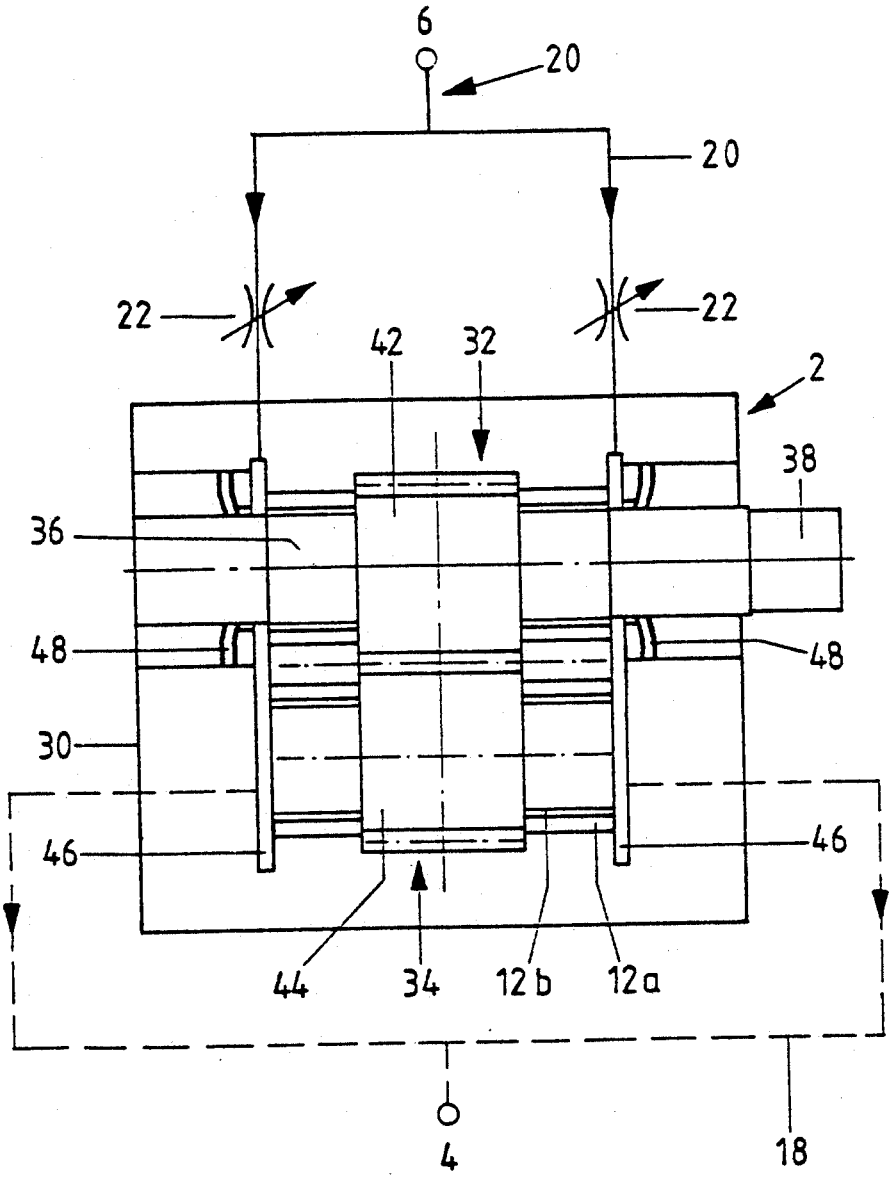
FIG. 2 shows a flow diagram corresponding to the embodiment of FIG. 1.

In the flow diagram of FIG. 2, the system of passage 8 is shown on the basis of a schematic cross-sectional diagram of gear pump 2. This comprises gear bodies 32, 34, which are mounted in a housing 30. Bearing journals 36 of the gear bodies are held in plain bearing bushes 12*a* of bearing 12. A drive shaft 38 of gear body 32 passes out through housing 30 and is coupled to a drive motor (not shown). Bearing journals 36 of gear bodies 32, 34, in conjunction with plain bearing bushes 12*a*, form the boundaries of clearance gaps 12*b*, shown larger than they really are. Gear bodies 32, 34 comprise gear wheels 42, 44, which mesh with each other. Collecting chambers 46 are connected to the ends of bearing 12 facing away from the gear wheels. These two collecting chambers 46 are connected by way of converging branches of passage 18 to inlet side 4 of pump 2. Shaft seals are indicated at 48, which, together with drive shaft 38, seal off collecting chambers 46 against the outside.

It is already clear from the preceding explanation of FIG. 2 that passage 10 shown in FIG. 1 represents the connection between the interior space of housing 30, in which gear wheels 42, 44 are installed, and clearance gaps 12*b* of bearing 12. On the sides of gap 12*b* facing gear wheels 42, 44, the prevailing pressure is therefore approximately the same as the pressure at outlet 6 of pump 2; these sides therefore correspond to pressure side 14 of bearing 12 in FIG. 1. Furthermore, collecting chambers 46 in FIG. 2 correspond to low pressure side 16 of this bearing.

As can now also be seen clearly from the illustration according to FIG. 2, bypass 20 according to FIG. 1 divides into two branches, each of which is connected to one of the collecting chambers 46. Each branch contains a valve element 22. It remains to be noted that valve elements 22 are connected to a control system with electromagnetic actuators (not shown). Of course, the actuating elements can also operated on the pneumatic or hydraulic principle.

During normal conveying operation of pump 2, valve elements 22 are usually completely closed, with the result that no conveyed product can flow through bypass 20. When pump 2 is to be cleaned after the completion of a pumping operation, for example, or to prepare for the pumping of a different product, in which case the pump would require a flushing agent, collecting chambers 46 can be flushed with a stream of flushing agent directly, i.e. bypassing bearing 12, by opening the two valve elements 22. Because the flushing stream flowing by way of the branches of bypass 20 is derived from pressure side 6 of pump 2, the flow velocities reached on low pressure side 16 of bearing 12 can be much higher than those of the lubricating stream. Any product deposits present in the potential dead spaces are thus reliably flushed away and discharged through the branches of passage 18. To cope with the different flow conditions in the two collecting chambers 46, it can be advisable not to open the two valve elements 22 to the same degree. The degree to which the valves are opened can be designed to be adjustable and can thus be adapted to the flow properties of the flushing agent.

Because the flushing stream originating from bypass 20 has the tendency to throttle the stream normally flowing by way of bearing 12, it can also be advisable to open the valve element only intermittently during the cleaning operation. This makes it possible for the bearing lubrication stream formed by the flushing agent to flow away freely and also for bearing gaps 12*b* to be cleaned reliably.

The flushing action of the stream originating from bypass 20 described above can also be utilized advantageously in certain cases in which product is being conveyed. When a sensitive product is involved, the valve elements 22, 22 can be opened periodically, for example, to achieve the effect that a flushing stream consisting of the product itself now flows through collecting chambers 46 and thus also through the potential dead spaces, thus opposing or preventing the formation of deposits in these spaces. Under the assumption of properly designed valve elements and their actuation, it is possible to take into account the flow properties of the individual product in question by opening the valves to the appropriate degree.

Figure 3:
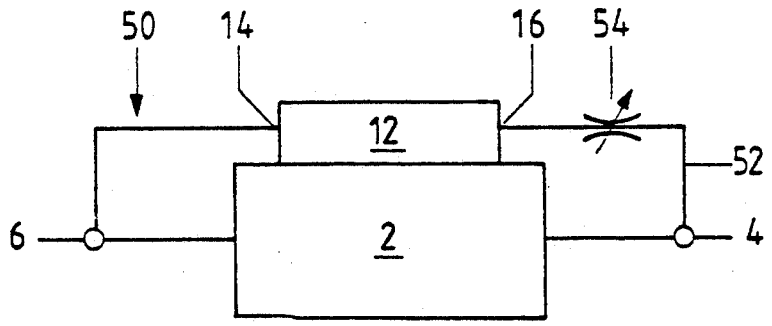
FIG. 3 shows a schematic diagram of a second embodiment.

The exemplary embodiment according to FIG. 3 differs from those according to FIGS. 1 and 2 primarily in that the system of passages does not include a bypass. The system of passages designated 50 in FIG. 3 is provided with a valve element 54, designed as a throttle valve, in passage 52, which is connected to low pressure side 16 of bearing 12. This valve is actuated electromagnetically. Under normal product conveying conditions, the vale is, for example, half-open to allow the passage of only the amount of product required to lubricate the bearing. For a cleaning operation, for which the internal losses in the output of pump 2 are irrelevant, valve element 54 is opened all the way. Thus the part of the system of passages including bearing 12 and especially the potential dead spaces on the low pressure side of this bearing can be flushed out with a high velocity flushing stream. It is obvious that, although only one bearing has been mentioned and illustrated, the system of passages comprises all bearings of pump 2 in this case as well and that passage 52 can have a corresponding branch and possibly a valve element 54 for each side of the housing. Here, too, it is also possible to provide a hydraulic or pneumatic actuating system for the valves instead of an electromagnetic one.

It is also possible in this embodiment to make use of the valve element when product is being conveyed. By changing the degree to which the valve element is opened, it is possible to adjust the bearing lubrication stream independently of other operating parameters. The bearing lubrication stream can therefore be adapted to the flow behavior of the product, and it can be changed while the product is being conveyed.

The invention can also be applied advantageously in cases where the products to be conveyed suffer degradation under the effect of thermal and/or mechanical influences as they lubricate the bearings. For such products, the bearing lubrication stream is not returned to inlet channel 4, but rather carried away separately. In a gear pump designed according to the invention, a valve element for this type of application is installed in the discharge section or in each of the branches of the discharge section to make it possible to influence the flow through the bearings in the way described above.

A latitude of modification, change and substitution is intended in the foregoing disclosure, and in some instances, some features of the invention will be employed without a corresponding use of other features. Accordingly, it is appropriate that the appended claims be construed broadly and in a manner consistent with the spirit and scope of the invention herein described.

What is claimed is:

1. A gear pump comprising:

a housing (30) provided with an inlet channel (4) and an outlet channel (6);

a plurality of gear bodies (32, 34) having bearing journals (36);

bearings for rotatably supporting said bearing journals and hence said gear bodies in the housing;

said bearings having a high pressure side disposed towards said gear bodies and a low pressure side disposed towards ends of said bearing journals;

a system of passages (8), which includes said bearings, being connected to the outlet channel to permit circulation of a leakage stream of product being conveyed, characterized in that the system of passages includes at least one adjustable valve element (22), for varying flow on the low pressure side (16, 46) of said bearings.

2. A gear pump according to claim 1, wherein said valve element (22) is installed in a bypass passage system (20), which is parallel to passages which include the high pressure sides of said bearings (12).

3. A gear pump according to claim 2 wherein said bearings include passages for the flow of a lubricant;

said bypass passage system coupling said bearing passages to said outlet channel.

4. A gear pump according to claim 1 characterized in that the valve element (22) is installed between a bearing (12) and the inlet channel (4).

5. A method for lubricating a gear pump comprised of a housing provided with an inlet channel and an outlet channel, a plurality of gear bodies having bearing journals and bearings for rotatably supporting said bearing journals and hence said gear bodies in said housing, said gear pump having passages including said bearings, said method comprising the steps of:

introducing a leakage stream of the medium conveyed by the gear pump outlet channel to the bearings;

returning said leakage stream flowing through the bearing passages to the inlet channel;

adjusting the flow conditions on the side of the bearing connected to the inlet channel;

adjusting the flow conditions as a function of the medium being conveyed; and providing a leakage flow of a flushing agent different from the product normally handled through the bearings when cleaning the gear pump and adjusting the amount of leakage flow of the flushing agent.

6. The method of claim 5 wherein the step of adjusting the leakage flow of the flushing agent includes adjusting the leakage flow of the flushing agent so that it is different from that of the product.

7. A gear pump according to claim 1, wherein the bearings of said gear bodies on one side thereof and on another side thereof, respectively, form a set of bearings, each set of bearings having a bearing linking passage (46) remote from said high pressure sides of the respective bearings, said system of passages (8) comprising two subsystems of passages, each including one of said sets of bearings.

8. A gear pump according to claim 1, wherein said system of passages (8) comprises passages (18, 52) each connecting said bearings at a location remote from their high pressure side to said inlet channel (4).

9. A gear pump according to claim 8, wherein said passages (52) connecting said bearings (16) to said inlet channel (4) each comprise at least one valve (54) element.

10. A gear pump according to claim 2, wherein said bypass passage system connects at least one of said outlet channel (6) and of said inlet channel (4) to said bearings remote from their high pressure sides.

11. A gear pump according to claim 2, said system of passages (8) further comprising passages connecting said bearings remote from their high pressure sides to said inlet channel.

12. A gear pump according to claim 10, wherein said bypass system connects said at least one of said inlet and outlet channels to said low pressure side of said bearings.

13. A gear pump according to claim 1, wherein said valve element is designed as a throttle.

14. A gear pump according to claim 1, wherein said system of passages (8) comprise passages respectively (12*b*) between said high pressures sides (14) and said low pressure sides (16, 46) of said bearings.

15. A gear pump according to claim 4, wherein said passages connecting said bearings to said inlet channel connect said low pressure side of said bearings to said inlet channel.

16. A gear pump according to claim 1, wherein a valve element is coupled to each of said bearings.

17. A gear pump according to claim 1, wherein said valve element is adjustable from a location outside said housing.

18. A method for lubricating a gear pump comprised of a housing provided with an inlet channel and an outlet channel, at least two gear bodies having bearing journals and bearings for rotatably supporting said bearing journals and hence said gear bodies in said housing, said gear pump having passages including said bearings, said method comprising the steps of:

introducing a leakage stream of the medium conveyed by the gear pump outlet channel to the bearings;

returning said leakage stream to the inlet channel;

adjusting flow conditions of a stream of medium from said outlet channel to said bearings by flow adjusting means being adjusted independently of the operating characteristics of said gear bodies; providing a flow of a flushing agent different from the product normally handled through the bearings when cleaning the gear pump and adjusting a flow amount of the flushing agent by adjusting the flow conditions wherein adjusting the flow of said flushing agent includes adjusting a leakage stream of said flushing agent so that it is different from that of the product.

19. The method of claim 18 further comprising the step of temporarily changing said flow conditions during conveyance of a medium through the gear pump.

20. The method of claim 18 further comprising the step of adjusting said flow conditions as a function of the medium being conveyed.

21. The method of claim 18 comprising the step of intermittently adjusting said flow conditions to intermittently provide a flushing stream of medium and a lubricating leakage stream to said bearings.

22. The method of claim 18 whereby adjusting said leakage stream to act as a lubricating stream is accomplished by adjusting said stream.

23. A gear pump comprising:

a housing (3) provided with an inlet channel (4) and an outlet channel (6);

at least two gear bodies (32, 34) having bearing journals (36);

bearings for rotatably supporting said bearing journals and hence said gear bodies in the housing;

said bearings having a high pressure side disposed towards said gear bodies and a low pressure side disposed towards ends of said bearing journals; and a system of passages (8), which includes at least one of said bearings, being connected from the outlet channel to its high pressure side and comprising valve means adjustable independently of the gears during operation of said pump.

* * * * *

UNITED STATES PATENT AND TRADEMARK OFFICE

CERTIFICATE OF CORRECTION

PATENT NO. : 5,253,988
DATED : October 19, 1993
INVENTOR(S) : Hunziker et al.

It is certified that error appears in the above-indentified patent and that said Letters Patent is hereby corrected as shown below:

Column 2, line 12, change "passage" to --passages--

Column 3, line 1, change "passage" to --passages--

Column 4, line 25, change "vale" to --valve--

Signed and Sealed this

Twelfth Day of July, 1994

*Attest:*

*Attesting Officer*

BRUCE LEHMAN

*Commissioner of Patents and Trademarks*